US007887207B2

(12) United States Patent
Saraiji et al.

(10) Patent No.: US 7,887,207 B2
(45) Date of Patent: Feb. 15, 2011

(54) MULTIPLE DOOR DISPLAY MERCHANDISER WITH LIGHTING ENHANCEMENT

(75) Inventors: Riad Saraiji, Falls Church, VA (US); Mark A. Daniels, Manlius, NY (US); Robert J. Reese, Spartanburg, SC (US); Stephen Kenney, North Syracuse, NY (US); Thomas E. Drago, Liverpool, NY (US)

(73) Assignee: Carrier Corporation, Farmington, CT (US)

( * ) Notice: Subject to any disclaimer, the term of this patent is extended or adjusted under 35 U.S.C. 154(b) by 386 days.

(21) Appl. No.: 11/886,033

(22) PCT Filed: Mar. 15, 2006

(86) PCT No.: PCT/US2006/009250

§ 371 (c)(1),
(2), (4) Date: Sep. 10, 2007

(87) PCT Pub. No.: WO2006/101874

PCT Pub. Date: Sep. 28, 2006

(65) Prior Publication Data

US 2008/0165526 A1 Jul. 10, 2008

Related U.S. Application Data

(60) Provisional application No. 60/663,081, filed on Mar. 18, 2005.

(51) Int. Cl.
*F21S 2/00* (2006.01)

(52) U.S. Cl. ..... 362/92; 362/94; 362/133

(58) Field of Classification Search ..... 362/92, 362/94, 133, 154, 155, 241, 243, 298, 329, 362/346, 125, 126, 127, 132; 312/116
See application file for complete search history.

(56) References Cited

U.S. PATENT DOCUMENTS

| | | | | |
|---|---|---|---|---|
| 2,148,159 | A * | 2/1939 | Hill | 362/126 |
| RE22,735 | E | 3/1946 | James | |
| 4,381,876 | A | 5/1983 | Fenwick | |
| 4,457,140 | A | 7/1984 | Rastelli | |
| 4,507,714 | A | 3/1985 | Aschinger et al. | |
| 4,941,289 | A | 7/1990 | Rolek | |
| 4,977,754 | A | 12/1990 | Upton et al. | |
| 5,016,146 | A | 5/1991 | Kaspar | |
| 5,297,863 | A | 3/1994 | Richardson et al. | |
| 5,471,372 | A | 11/1995 | Mamelson et al. | |
| 5,508,898 | A | 4/1996 | McGovern | |
| 5,584,189 | A | 12/1996 | Bustos | |

(Continued)

FOREIGN PATENT DOCUMENTS

| | | |
|---|---|---|
| JP | 406307761 | 11/1994 |

*Primary Examiner*—Sharon E Payne
(74) *Attorney, Agent, or Firm*—Marjama Muldoon Blasiak & Sullivan LLP

(57) ABSTRACT

The display space of a multiple door display merchandiser is illuminated by one or more vertically extending lamps (80) disposed intermediate the vertical sides of an access opening to the display space. A multiple door assembly (44) covers the access opening. To enhance the illumination of the display space, a pair of vertically extending side reflectors (92) are provided, one extending along one side of the access opening and the other extending along the other side of the access opening. An additional reflector may be mounted to an interior facing surface of the door along an upper front region of the door and/or a lower front region.

12 Claims, 4 Drawing Sheets

U.S. PATENT DOCUMENTS

| | | | |
|---|---|---|---|
| 5,645,330 | A | 7/1997 | Artwohl et al. |
| 5,699,676 | A | 12/1997 | Trulaske, Sr. |
| 5,865,516 | A | 2/1999 | Woy |
| 5,873,646 | A | 2/1999 | Fjaestad et al. |
| 5,937,666 | A | 8/1999 | Trulaske, Sr. |
| 6,098,529 | A | 8/2000 | Brummett et al. |
| 6,302,557 | B1 | 10/2001 | Santosuosso et al. |
| 6,401,399 | B1 | 6/2002 | Roche et al. |
| 6,406,108 | B1 | 6/2002 | Upton et al. |
| 6,578,978 | B1 | 6/2003 | Upton et al. |

* cited by examiner

MULTIPLE DOOR DISPLAY MERCHANDISER WITH LIGHTING ENHANCEMENT

CROSS REFERENCE TO RELATED APPLICATIONS

Reference is made to and this application claims priority from and the benefit of U.S. Provisional Application Ser. No. 60/663,081, filed Mar. 18, 2005, and entitled LIGHTING ENHANCEMENT USING REFLECTIVE SURFACES IN BOTTLE COOLERS, which application is incorporated herein in its entirety by reference. This application is related to International (PCT) Patent Application Serial No. PCT/US05/047046, filed Dec. 23, 2005, and entitled DISPLAY MERCHANDISER WITH LIGHTING ENHANCEMENT, which application is incorporated herein in its entirety by reference.

FIELD OF THE INVENTION

This invention relates generally to display merchandisers and, more particularly, to improving illumination of product displayed within a lighted display merchandiser equipped with a plurality of glass doors.

BACKGROUND OF THE INVENTION

Display merchandisers, also commonly referred to as display cases or display cabinets, are widely used in merchandising products in department stores, bakeries, groceries, supermarkets, convenience stores and other retail establishments. Such merchandisers commonly have a glass front, and often also a glass top and even glass sides, through which consumers may view the products displayed within the merchandiser. Non-refrigerated display merchandisers are commonly used to display a wide range of products, including for example, jewelry, toys, electronic devices, baked goods, bottled and canned beverages. Refrigerated display merchandisers are commonly used to display perishable and frozen comestibles and beverages, including for example meats, poultry, fish, diary products, prepackaged frozen foods, cold bottled and canned beverages and other products that need to be maintained in a controlled environment.

It is well appreciated that illuminating the product displayed within the merchandiser can enhance the appearance of the displayed product to the consumer. Accordingly, both refrigerated and non-refrigerated display cases have often been equipped with lights placed within the interior of the cabinet to illuminate the product. For example, U.S. Pat. No. 6,098,529 discloses a non-refrigerated display case for food items, such as baked goods, wherein the interior of the cabinet is illuminated by a plurality of vertically arrayed incandescent lamps disposed in the rear corners of the cabinet and by a plurality of horizontally disposed, vertically spaced fluorescent lamps extending across the front of the cabinet. A front lighted display case, for displaying jewelry and the like, disclosed in U.S. Pat. No. 4,381,876, has a single, horizontally extending fluorescent light mounted at the upper front of the cabinet for illuminating product displayed therein. U.S. Pat. No. 5,865,516 discloses a display case for displaying scale models wherein the cabinet is illuminated by a plurality of low wattage lamps extending around the entire upper periphery of the interior of the cabinet.

Similarly, refrigerated display merchandisers, such as those commonly used in supermarkets, convenience stores, delis, fast food restaurants, and other commercial establishments to display refrigerated or frozen products for self-service selection, are customarily equipped with fluorescent lights to illuminate the product disposed on shelves within the merchandiser. U.S. Pat. No. 5,508,898 discloses an open-front refrigerated display case for food products wherein a pair of horizontally extending fluorescent lamps is disposed at the upper front of the cabinet with an associated reflector which directs the light from the lamps downwardly and into the cabinet to illuminate the forwardly-sloping shelves therein. Additionally, a horizontally extending fluorescent lamp is mounted to the underside of each shelve near the forward edge thereof with an associated reflector to illuminate that the next shelf there below and the region below the lowermost shelf.

U.S. Pat. No. 4,977,754 discloses a two-door, glass door, cold beverage merchandiser wherein a horizontally extending fluorescent lamp is mounted in a forward position in an upper region of the interior of the cabinet to illuminate the sloping shelves therein. Further, a horizontally extending fluorescent lamp is disposed in a separate compartment in association with a sign disposed at the upper front of the merchandiser so as to illuminate the sign. Glass-door, cold beverage merchandisers are also available that include a single horizontally-extending fluorescent lamp disposed at the upper front of the cabinet interior to light a sign disposed along the upper front of the cabinet, as well as illuminate shelves there below. A reflector is typically provided in association with the lamp to aid in directing light from the lamp downwardly toward the shelves.

U.S. Pat. Nos. 5,699,676 and 5,937,666 disclose a stand-alone double door, glass door, refrigerated merchandiser wherein a vertically extending fluorescent lamp is mounted to each door so as to extend along the respective sides thereof at a front corner of the cabinet to provide light to illuminate the interior of the cabinet. U.S. Pat. No. 6,406,108 discloses a stand-alone double door, glass door, refrigerated merchandiser wherein each door is provided with a pair of vertically extending fluorescent lamps and a pair of horizontally extending fluorescent lamps mounted about the perimeter of the inwardly facing surface of the door to light the interior of the merchandiser cabinet. U.S. Pat. No. 5,584,189 discloses a hexagonally-sided refrigerated merchandiser wherein three vertically extending fluorescent lamps are disposed in the wall of the cabinet at equally spaced intervals about the periphery of the interior of the cabinet to illuminate the horizontal shelves therein.

It is also known in the art with respect to multiple door refrigerated merchandisers to mount a vertically extending fluorescent lamp to the inwardly facing surface of a structural member, commonly referred to as a mullion, of the door frame assembly extending vertically between each set of doors to illuminate the interior of the merchandiser. For example, U.S. Pat. No. 6,578,978 discloses a stand-alone, two door, refrigerated display case having a central support mullion having an outwardly facing surface against which the doors close and an inwardly facing surface on which are mounted a pair of vertically extending fluorescent lamps for illuminating product disposed on shelves within the interior of the display case. U.S. Pat. Nos. 4,941,289; 5,016,146 and 5,645,330 each disclose a door assembly for mounting within an opening in a wall of a refrigerated cabinet, the door assembly including a frame having a vertically extending support mullion between each set of doors mounted to the frame. A vertically extending fluorescent lamp is mounted to the inwardly facing surface of each mullion for illuminating the interior of the cabinet. In U.S. Pat. No. 5,297,863, a multiple door, glass-door display case is disclosed wherein vertically extending fluorescent lamps are disposed near both front corners and between the doors of the display case to illuminate a plurality of horizontal shelves.

Such lighting systems typically do not uniformly illuminate the interior of the cabinet, but rather more intensely illuminate regions closer to the lamp or lamps, while less intensely lighting regions more distant from the lamp. In U.S. Pat. No. 5,471,372, a glass door refrigerated merchandiser is disclosed having a door assembly comprising a pair of insulated glass doors mounted for swinging movement in a door frame mounted within an opening in the front wall of the cabinet. The door frame includes a vertically extending center mullion. To illuminate product on shelves within the refrigerated merchandiser, a vertically extending light fixture is mounted to and rearward of the door frame along each side of the frame and a central vertically extending light fixture is mounted to and rearward of the center mullion. Each light fixture includes a vertically extending fluorescent lamp within in a uniquely constructed light refracting/reflecting lens mounted to a base member. A V-shaped reflector is mounted to the base member in back of the lamp with its apex pointing toward the bulb. Although effective in substantially uniformly distributing light into the interior of the merchandiser, such a lighting system is relatively expensive due to the number of lamps and the elaborate lenses required.

SUMMARY OF THE INVENTION

It is an object of the invention to provide a multiple-door display merchandiser having a relatively inexpensive and effective lighting system for illuminating an interior product display space within the merchandiser.

It is an object of the invention to provide a multiple-door display merchandiser incorporating reflectors having a relatively high reflectivity surface configured and positioned to direct light into an interior product display space within the merchandiser.

It is an object of an aspect of the invention to provide a multiple-door display merchandiser having a lighting system incorporating at least one lamp located between a pair of side reflectors at the front corners of an interior product display space within the merchandiser, the reflectors having a relatively high reflectivity surface adapted to direct light emitted from the lamp into the side regions of the interior product display space.

A display merchandiser is provided having an improved lighting system for illuminating an interior product display space within the display merchandiser. In one embodiment of the invention, the display merchandiser includes a structure defining an opening through which at least a portion of the display space may be accessed, a door assembly covering the access opening, at least one vertically extending lamp, a first reflector and a second reflector. The door assembly includes a plurality of transparent doors, each door being selectively positionable between a first position in which it closes the access opening to access to the display space and a second position in which it opens the access opening for access to the display space. The access opening is bounded by a first vertically extending side and a second vertically extending side being opposite said first side. The at least one vertically extending lamp is disposed behind the door assembly intermediate the first side and the second side of the access opening. The first reflector is disposed along the first side of the access opening and the second reflector is disposed along the second side of the access opening. The first and second side reflectors are adapted to direct at least portion of the light emitted from the lamp into the display space.

In another embodiment, a refrigerated merchandiser is provided having an improved lighting system for illuminating an interior product display space within the refrigerated merchandiser. The refrigerated merchandiser includes a refrigerated cabinet defining the interior product display space bounded by a top, a base, a surrounding side wall structure including a plurality of insulated side walls extending between the top and the base. An opening is provided in the surrounding side wall structure through which the interior product display space may be accessed. The access opening is covered by a plurality of doors each of which has a transparent viewing area through which at least a portion of the interior product display space can be viewed. Each door is selectively positionable between a first position in which it closes the access opening to access to the interior product display space and a second position in which it opens the access opening to access to the interior product display space. A vertically extending lamp is disposed behind the door assembly intermediate a first vertical side and a second vertical side of the access opening. A first reflector is disposed along the first side of the access opening and a second reflector is disposed along the second side of the access opening. The first and second side reflectors are adapted to direct at least portion of the light emitted from said lamp into the display space.

In addition to the side reflectors, a first horizontally extending reflective surface may be disposed on an interior facing surface along an upper portion of at least one door of the plurality of doors and a second horizontally extending reflective surface may be disposed on an interior facing surface along a lower portion of at least one door of the plurality of doors. Additionally, a mullion may extend vertically upwardly across the access opening intermediate the first side and the second side of the access opening. The vertically extending lamp may be mounted to the mullion.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
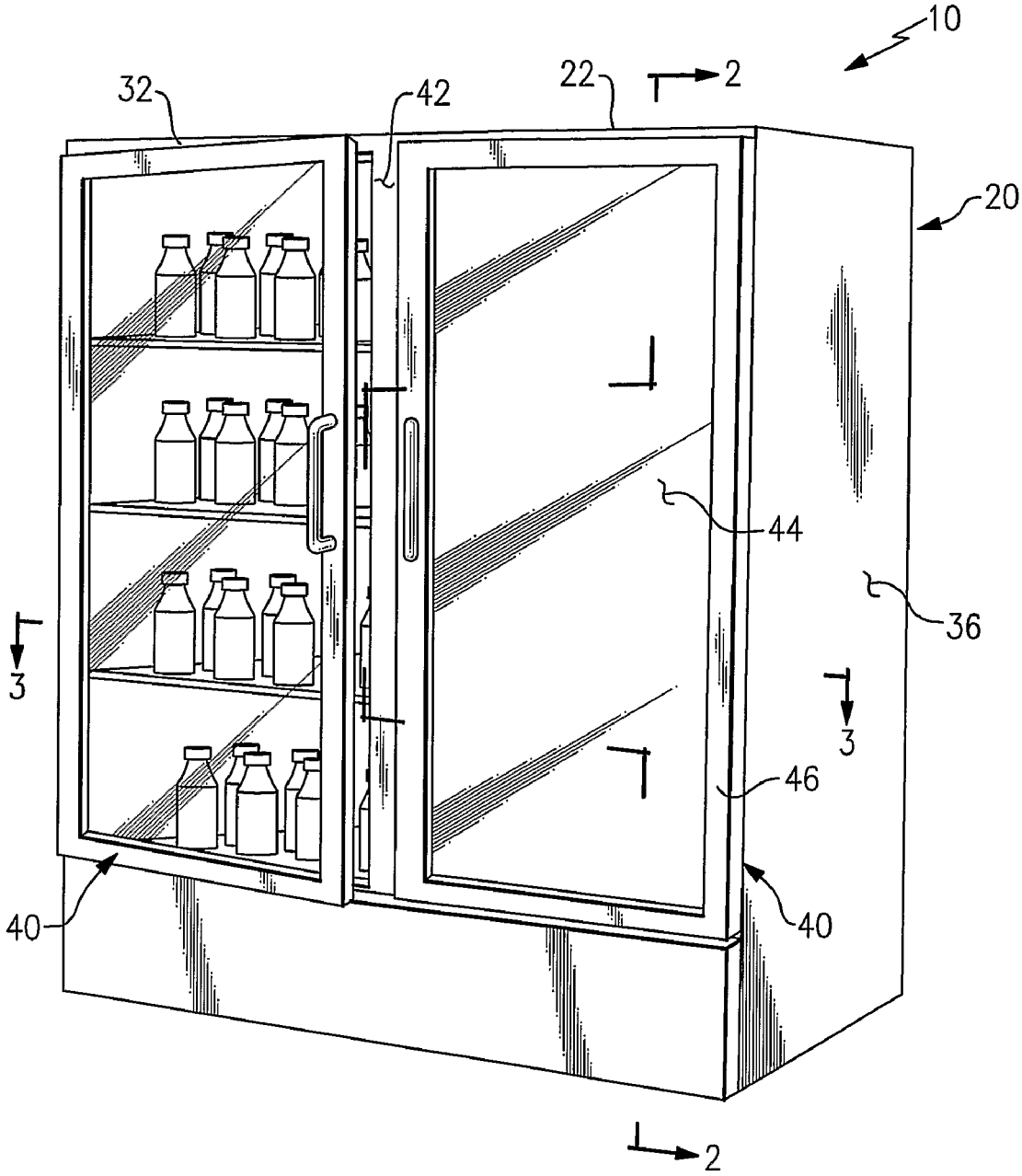
FIG. 1 is a perspective view of a refrigerated merchandiser in accord with the present invention.
Figure 2:
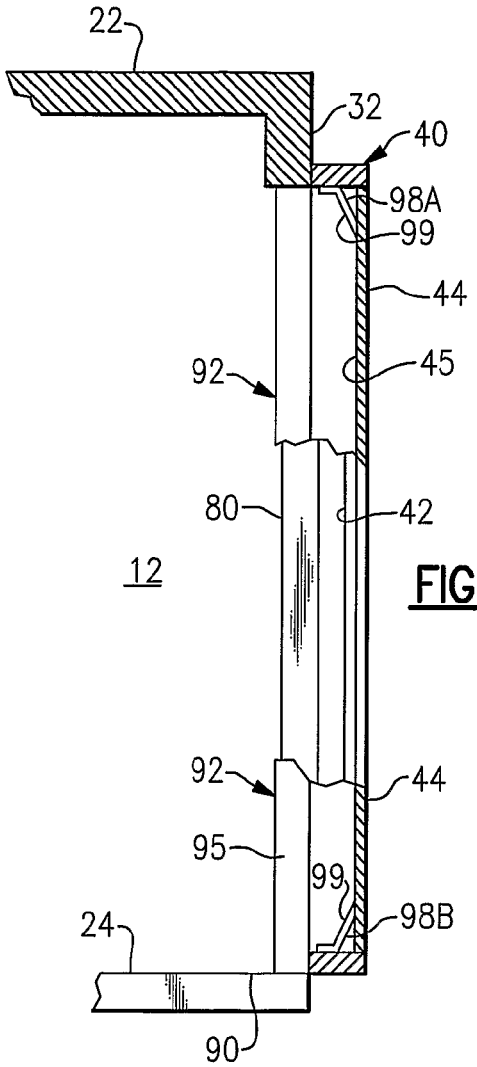
FIG. 2 is a sectioned elevation view taken along line 2-2 of FIG. 1.
Figure 3:
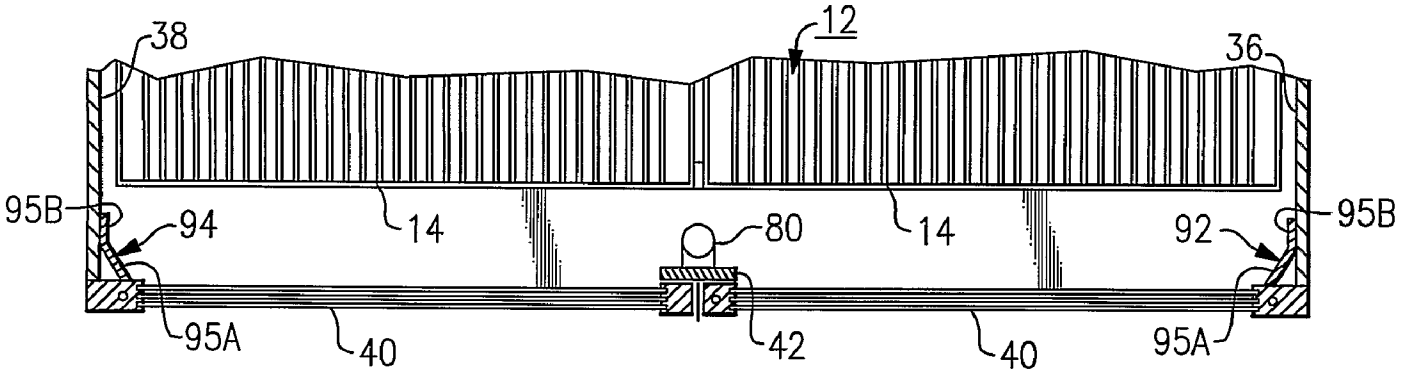
FIG. 3 is a sectioned plan view taken along line 3-3 of FIG. 1.

Referring now to FIGS. 1-3, there is depicted a two door, cold beverage merchandiser, designated generally by the reference numeral 10, including a cabinet 20 defining an interior product display space 12 having shelves 14 for holding product to be purchased, such as for example bottled or canned soda, milk, water, juices, fruit drinks, beer and other beverages. The refrigerated cabinet 20 has a top wall 22, a base wall 24, and a surrounding wall structure formed of a plurality of insulated bounding walls, including vertically extending side walls 36 and 38. An open area is provided in the front of the cabinet 20 through which the interior product display space may be viewed from exteriorly of the cabinet. A central mullion 42 that extends vertically upright through the open area. In the depicted embodiment, the open area is covered by a pair of doors 40 that are selectively positionable between a closed position covering the open area and an open position in which consumers may access the interior product display space 12 to remove a product for purchase. The doors 40 may be mounted to the cabinet 20 in a conventional manner, for example on hinges for pivotal movement between an open and closed position or on a tract for sliding movement between an open and closed position. Each door 40 has a transparent viewing area, for example a glass panel assembly 44, typically having one, two or three glass panels, mounted in frame 46, through which at least a portion of the interior product display space of the cabinet 20 can be viewed through the open area 35 in the front side wall 32.

As in conventional stand-alone refrigerated merchandisers, a refrigeration unit (not shown) is housed within the cabinet, for example in a compartment beneath the product display space, in operative association with the interior product display space for providing refrigerated air thereto. The refrigeration unit includes a compressor, a condenser/condenser fan assembly and an evaporator/evaporator fan assembly with the compressor, condenser and evaporator connected via refrigerant lines in a conventional refrigeration circuit. The evaporator fan is operative in a conventional manner to circulate air through the evaporator and interior product display space. As in conventional practice, the evaporator/evaporator fan assembly may be disposed within a compartment beneath or above the interior product space display or located within the product display space. It is to be understood that the particular mode of refrigerating the interior product display space 12 is not germane to the invention.

As discussed hereinbefore, it is desirable to illuminate the interior product display space and the product disposed therein to enhance the appearance of the product disposed on the shelves to the consumer viewing the product through the glass doors. A vertically extending lamp 80, preferably a fluorescent light, is positioned within the interior of the cabinet behind the center mullion 42 and forward of the shelves 14. When energized, the lamp 80 emits light directly into the interior product display space 12. Although light emitted from the lamp 80 will, by itself alone, effectively illuminate product disposed on the front central portion of the interior of the cabinet, that light will only poorly illuminate product disposed on portions of the shelves more toward the sides of the interior of the cabinet. The specific number, arrangement and configuration of the shelves 14 is not germane to the invention and is within the skill of an ordinary practitioner in the art to select for optimizing the presentation of and the customer accessibility to the particular product being displayed.

Commonly, the interiorly facing surfaces of the walls bounding the interior product display area 12 are relatively non-reflective or of relatively low reflectivity. Therefore, most of the light emitted from the lamp 80 that impinges upon these bounding surfaces is absorbed. In one aspect of the invention, to enhance the illumination of the side regions of the interior product display space, highly reflective surfaces are disposed at specific locations relative to the lamp 80. The reflective surfaces of the lighting system of the invention will reflect, rather than absorb, a significant portion of the light from the lamp 80 that impinges thereon into the side regions of interior product display space 12, thereby enhancing illumination of the product disposed therein.

Figure 6:
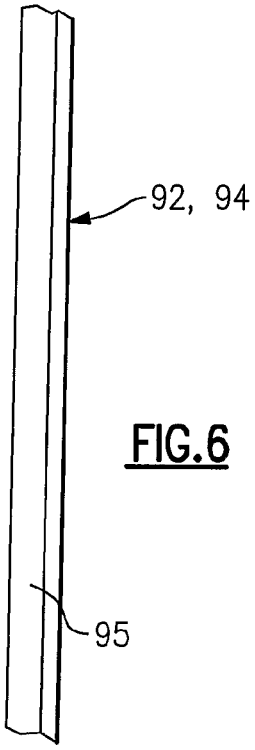
FIG. 6 is a perspective view of a side reflector strip.
Figure 7:
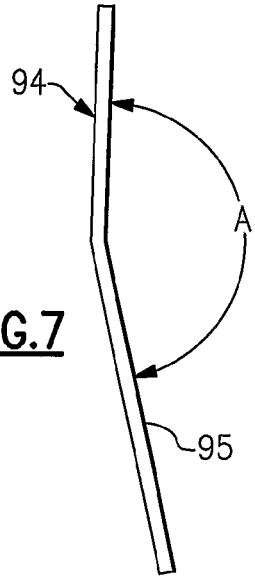
FIG. 7 is a sectioned view of an embodiment of a side reflector strip.

Referring now to FIGS. 2 and 3 in particular, a first side reflector 92 and a second side reflector 94 are disposed at the respective front corners of the interior of the cabinet 20. The first side reflector 92 extends vertically along the right side wall 36 near the front edge thereof and the second side reflector 94 extends vertically along the left side wall 38 near the front edge thereof. Each of the side reflectors 92 and 94 has a reflective surface 95 facing the interior of the cabinet 20. The side reflectors 92 and 94 may extend the full height of the interior product display space 12 or may be foreshortened so as to extend for only a portion of the height of the interior product display space 12. Each of the side reflectors 92 and 94 is contoured or otherwise configured with its respective reflective surface 95 having a portion 95A extending obliquely to the respective side walls 36 and 38 and facing inwardly toward the interior product display space 12. Each of the reflective surfaces 95A reflects light inwardly into the respective side regions of the interior product display space 12. Additionally, each of the reflectors 92 and 94 may be contoured or otherwise configured with its respective reflective surface 95 having a portion 95B extending generally parallel to the respective side walls 36 and 38. Each of the reflective surfaces 95B reflects light inwardly back across the front of the interior product display space 12 as well as along the front portion of the shelves therein and the glass panel assembly 44 of the door 40 positioned between the lamp 80 and the respective side reflector. The side reflectors 92 and 94 may comprise simple, elongated strips bent along a longitudinal line at an included angle, A, with the respective interior surface 95 being reflective, such as depicted in FIGS. 6 and 7.

Figure 5:
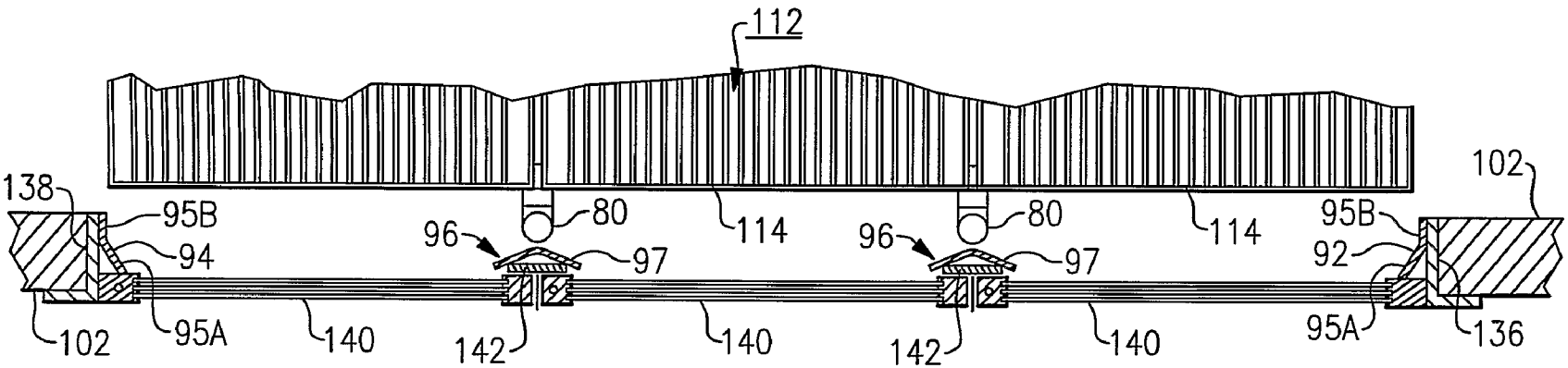
FIG. 5 is a sectioned plan view taken along line 5-5 of FIG. 4.
Figure 4:
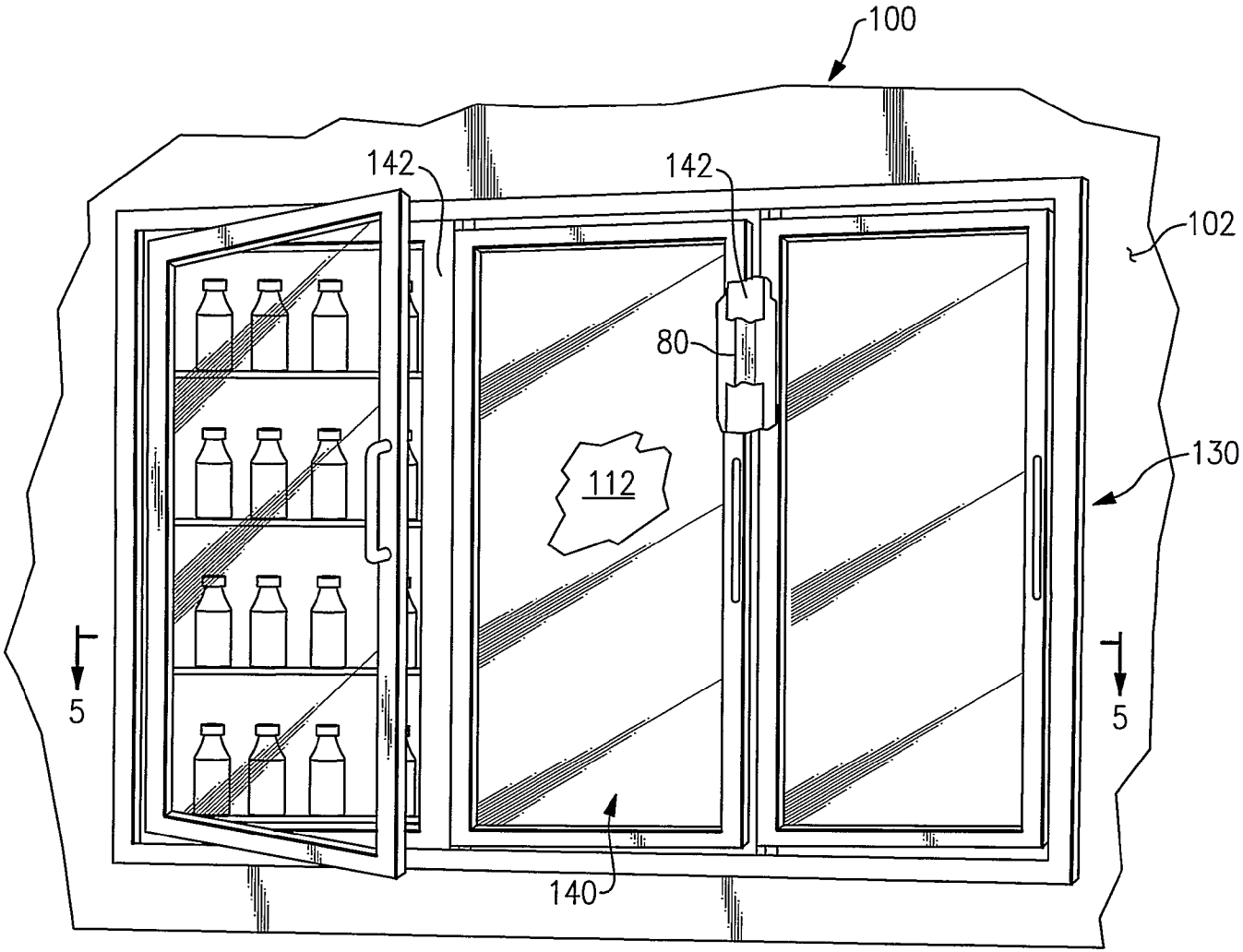
FIG. 4 is a front elevation view of a display case in accord with the present invention.

Referring now to FIGS. 4 and 5 in particular, there is depicted a refrigerated display case, designated generally by the reference numeral 100, of the type commonly used in supermarkets and other retail stores for displaying refrigerated foods, frozen foods, diary products and the like. The refrigerated display case includes a door assembly comprising a plurality of glass doors 140 arrayed in side-by-side arrangement within a perimeter frame 130 and mounted thereto for swinging movement. The frame 130 is mounted within and extends about the periphery of an open area in the wall 102, for example the wall of a cold-room or the front wall of a refrigerated display case. A refrigerated display space 112 is defined behind the glass doors 140 wherein product is displayed on shelves 114. The specific number, arrangement and configuration of the shelves 114 is not germane to the invention and is within the skill of one of ordinary skill in the art to select for optimizing the presentation of and the customer accessibility to the particular product being displayed. The frame 130 includes a plurality of mullions 142 extending vertically between the top and bottom members of the frame to provide rigidity to the frame.

As in conventional practice in connection with display cases of this type, an evaporator/evaporator fan assembly is operatively associated with the display space 112 for circulating air from the display space through the evaporator and back into the display space. The evaporator is connected in refrigerant flow communication with a compressor rack and a condenser via refrigerant lines in a conventional refrigeration circuit, both of which are typically located remotely from the display space.

Referring now to FIG. 5 in particular, a plurality of vertically extending lamps 80, preferably fluorescent lights, are provided to illuminate the display space and the product disposed on the shelves 114 to enhance the appearance of the product disposed on the shelves to the consumer viewing the product through the glass doors 140. A lamp 80 is positioned behind each of the mullions 142 and forward of the shelves 114. When energized, the lamps 80 emit light directly into the display space 112. In the depicted embodiment of a display case with a three-door, glass door assembly, two lamps 80 are provided, a first lamp being behind the left mullion and a second lamp being behind the right mullion. Although light emitted from the lamps 80 will effectively illuminate product disposed on the shelves in the region of the display space in the general vicinity of the lamps, that light will only poorly illuminate product disposed in regions of the product display more toward the sides of the interior of the cabinet.

A first side reflector 92 and a second side reflector 94 are disposed at the respective front corners of the interior of the display space 112. The first side reflector 92 extends vertically along the right side of the glass door assembly and the second side reflector 94 extends vertically along the left side of the glass door assembly. Each of the side reflectors 92 and 94 has a reflective surface 95 facing the interior of the display space 112. The side reflectors 92 and 94 may extend the full height of the door assembly or may be foreshortened so as to extend for only a portion of the height of the door assembly. Each of the side reflectors 92 and 94 may be contoured or otherwise configured with its respective reflective surface 95 having a portion 95A extending obliquely and facing inwardly toward the display space 112. Each of the reflective surfaces 95A reflects light inwardly into the respective side regions of the display space 112. Additionally, each of the reflectors 92 and 94 may be contoured or otherwise configured with its respective reflective surface 95 having a portion 95B extending generally parallel to the respective side flanges 136 and 138 of the perimeter frame 130. Each of the reflective surfaces 95B reflects light inwardly back across the front of the front portion of the shelves 114 and the glass panel assembly of the door 140 positioned between the respective lamp 80 and its respective side reflector. The side reflectors 92 and 94 may comprise simple, elongated strips bent along a longitudinal line at an included angle, A, with the respective interior surface 95 being reflective, such as depicted in FIGS. 6 and 7.

To further enhance illumination of the product on the shelves 114, particularly in the region intermediate the two lamps 80, a base reflector 96, having a reflective surface 97, may be disposed in operative association with and extending along each lamp 80. Each base reflector is contoured or otherwise configured and positioned relative to its associated lamp 80 such that the reflective surface 97 thereof will reflect light emitted from the lamp 80 generally inwardly and obliquely into the display space. For example, as illustrated in the depicted embodiment, each base reflector 96 may be a reflective strip mounted behind the mullion 142 with its reflective surface 97 facing its associated lamp 80 and appropriately shaped, for example, generally V-shaped, generally U-shaped, or otherwise cusped and accurate, so that its reflecting surface 97 reflects light emitted from its associated lamp 80 back into the display space through a desired arc.

Additional reflectors 98 may be provided on the indoor side of each of the doors 40, one positioned to extend along the top of the door and the other to extend along the bottom of the door. For example, referring now to FIG. 2, a horizontally extending upper door reflector 98A may be disposed against an upper portion of the inside surface 45 of the glass panel assembly 44 of the door 40 and a horizontally extending lower door reflector 98B may be disposed against a lower portion of the inside surface 45 of the glass panel assembly 44 of the door 40. Each reflector 98 has a reflective surface 99 that faces generally inwardly toward the display space 12. The upper reflector 98A may be positioned and contoured or otherwise configured such that its reflective surface 99 reflects light inwardly and generally downwardly into the display space 12 when the door 40 is closed. The lower reflector 98B may be positioned and contoured or otherwise configured such that its reflective surface 99 reflects light inwardly and generally upwardly into the display space 12 when the door 40 is closed.

The reflectors 92, 94, 96 and 98 may comprise a structural support strip having a reflective surface on the side that will face the interior of the product display space. The strips may be formed sheet metal strips, for example anodized aluminum, having a polished surface as a reflective surface or a having a reflective paint or other reflective material coating deposited thereon as a reflective surface. The strips may be extruded strips configured to the desired contour during the extrusion process and having a reflective coating deposited, for example extruded plastic, PVC resin or aluminum substrate laminated with a skin of reflective aluminum or aluminized Mylar to provide the reflective surface. The reflectors may be mounted to the cabinet structure, frame structure and door structure, as appropriate, by any suitable attachment technique, such as for example mechanical fasteners, including screws, magnetic strips, hook-and-loop fabric with adhesive on both sides, double-sided tape, or adhesive. Those skilled in the art will appreciate that the width and length of each reflector and the included angle in the reflective surface will depend upon the geometry and dimensions of the product display space and exact placement of the reflectors thereto.

While the present invention has been particularly shown and described with reference to the embodiments as illustrated in the drawing, it will be understood by one skilled in the art that various changes in detail may be effected therein without departing from the spirit and scope of the invention as defined by the claims.

We claim:

1. A display merchandiser having an improved lighting system for illuminating a display space of said display merchandiser, said display merchandiser comprising:

a structure defining an access opening in a front side wall through which at least a portion of the display space may be accessed, the access opening bounded by a first vertically extending side wall and a second vertically extending side wall being opposite said first vertically extending side wall;

a door assembly covering the access opening, said door assembly including a plurality of transparent doors, each door being selectively positionable between a first position in which it closes over the access opening to the display space and a second position in which it opens to provide access to the display space;

at least one mullion extending vertically upright through the access opening in the front side wall, each mullion dividing one transparent door of the plurality of transparent doors from another transparent door of the plurality of transparent doors;

at least one vertically extending lamp disposed behind the at least one mullion intermediate the first vertically extending side wall and the second vertically extending side wall of the access opening, said at least one lamp for emitting light into the display space;

a first reflector having a first oblique portion extending obliquely from said front side wall to said first vertically extending side wall of said access opening, and facing inwardly toward the interior product display space, said first oblique portion adapted to direct at least a portion of the light emitted from said at least one vertically extending lamp into the display space; and a second reflector having a second oblique portion extending obliquely from said front side wall to said second vertically extending side wall of said access opening, and facing inwardly toward the interior product display space, said second oblique portion adapted to direct at least a portion of the light emitted from said at least one vertically extending lamp into the display space.

2. A display merchandiser as recited in claim 1 wherein each door comprises a glass door having a glass panel mounted in a perimeter support frame.

3. A display merchandiser as recited in claim 1 wherein each door comprises a glass door selectively pivotal between its first and second positions.

4. A display merchandiser as recited in claim 1 wherein said first and second said reflectors have a portion extending generally parallel to said first vertically extending side wall and said second vertically extending side wall to direct at least a portion of the light emitted from said lamp back across said glass door assembly.

5. A display merchandiser as recited in claim 1 further comprising:

a horizontally extending reflective surface disposed on an interior facing surface along an upper portion of at least one door of said plurality of doors; and a horizontally extending reflective surface disposed on an interior facing surface along a lower portion of at least one door of said plurality of doors.

6. A refrigerated merchandiser having an improved lighting system for illuminating an interior product display space within said merchandiser, said refrigerated merchandiser comprising:

a refrigerated cabinet defining the interior display space bounded by a top, a base, a surrounding side wall structure including a plurality of insulated side walls extending between said top and said base, and an opening in the surrounding side wall structure through which the interior product display space may be accessed, the access opening bounded by a first vertically extending side and a second vertically extending side being opposite said first side;

a door assembly covering the access opening, said door assembly including a plurality of doors, each door having a transparent viewing area through which at least a portion of the interior product display space can be viewed, each door being selectively positionable between a first position in which it closes the access opening to access to the interior product display space and a second position in which it opens the access opening to access to the interior product display space;

at least one mullion extending vertically upright through the access opening, each mullion dividing one door of the plurality of doors from another door of the plurality of doors;

a vertically extending lamp disposed behind the at least one mullion intermediate the first side and the second side of the access opening, said lamp for emitting light into the display space;

a first reflector disposed along the first side of said access opening, said first reflector having a first portion extending obliquely to said first vertically extending side and adapted to direct at least a portion of the light emitted directly from said lamp into the display space; and a second reflector disposed along the second side of said access opening, said second reflector having a second portion extending obliquely to said second vertically extending side and adapted to direct at least a portion of the light emitted from said lamp into the display space.

7. A refrigerated merchandiser as recited in claim 6 further comprising:

a mullion extending vertically upwardly across the access opening intermediate the first side and the second side of the access opening.

8. A refrigerated merchandiser as recited in claim 7 wherein said vertically extending lamp is mounted to said mullion.

9. A display merchandiser as recited in claim 6 wherein each door comprises a glass door having a glass panel mounted in a perimeter support frame.

10. A display merchandiser as recited in claim 9 wherein each door comprises a glass door selectively pivotal between its first and second positions.

11. A display merchandiser as recited in claim 6 wherein said first and second said reflectors have a portion extending generally parallel to said first vertically extending side wall and said second vertically extending side wall to direct at least a portion of the light emitted from said lamp back across said glass door assembly.

12. A display merchandiser as recited in claim 6 further comprising:

a horizontally extending reflective surface disposed on an interior facing surface along an upper portion of at least one door of said plurality of doors; and a horizontally extending reflective surface disposed on an interior facing surface along a lower portion of at least one door of said plurality of doors.

* * * * *